US006103971A

United States Patent [19]

Sato et al.

[11] Patent Number: 6,103,971

[45] Date of Patent: Aug. 15, 2000

[54] CLEANER HOSE WITH INTERNAL SPIRAL WOUND STEEL AND RESIN FIBERS

[75] Inventors: Masaru Sato; Toshihiro Nakanishi; Hikaru Mizukoshi; Hiroyuki Masui, all of Osaka, Japan

[73] Assignee: Totaku Industries, Inc., Osaka, Japan

[21] Appl. No.: 09/110,242

[22] Filed: Jul. 6, 1998

[30] Foreign Application Priority Data

Jul. 7, 1997 [JP] Japan ..... 9-197912

[51] Int. Cl.[7] ..... F16L 11/04; F16L 11/11; F16L 11/118

[52] U.S. Cl. ..... 174/47; 174/120 R; 174/121 SR; 138/122; 138/134; 138/144; 138/129

[58] Field of Search ..... 174/47, 120 SR, 174/121 R, 121 SR; 138/122, 134, 144, 129, 132, 154, 153

[56] References Cited

U.S. PATENT DOCUMENTS

| | | | |
|---|---|---|---|
| 2,963,750 | 12/1960 | Pavlic | 156/144 |
| 4,203,476 | 5/1980 | Vitellaro | 138/122 |
| 4,224,463 | 9/1980 | Koerber et al. | 174/47 |
| 4,230,899 | 10/1980 | Kanao | 174/47 |
| 4,241,763 | 12/1980 | Antal et al. | 138/27 |
| 4,693,324 | 9/1987 | Choiniere et al. | 174/47 |
| 5,778,941 | 7/1998 | Inada | 138/134 |
| 6,024,132 | 2/2000 | Fujimoto | 138/122 |
| 6,024,134 | 2/2000 | Akedo et al. | 138/129 |

*Primary Examiner*—Kristine Kincaid
*Assistant Examiner*—Mark Olds
*Attorney, Agent, or Firm*—Whitham, Curtis & Whitham

[57] ABSTRACT

Two hard steel wire-made reinforcing wires and two synthetic resin wires which are harder than a soft synthetic resin pipe wall are alternately wound spirally on an inner side of the synthetic resin pipe wall while keeping predetermined intervals.

21 Claims, 6 Drawing Sheets

CLEANER HOSE WITH INTERNAL SPIRAL WOUND STEEL AND RESIN FIBERS

BACKGROUND OF THE INVENTION

The present invention relates to a cleaner hose for use with an electric vacuum cleaner in a state in which the cleaner hose is connected therewith. More particularly, the present invention relates to a cleaner hose with reinforced wires, in which reinforcing metal wires are spirally wound on the inner side of a pipe wall foxed of a soft synthetic resin material.

As the structure of such a conventional cleaner hose for use with an electric vacuum cleaner, generally known is such a structure that a pipe wall is formed into a spirally corrugated shape and a reinforcing metal wire is enclosed in the inside of the protrusion of the corrugated shape of the pipe wall in a state in which the reinforcing metal wire is bared, or the reinforcing metal wire is disposed on the inner peripheral side of the protrusion of the corrugated shape of the pipe wall in a state in which the reinforcing metal wire is coated with a resin.

As shown in FIG. 1, the above-described cleaner hose is connected between a suction pipe E of a vacuum cleaner body C and a auction pipe D on the top end of a hand-held operation pipe P. The cleaner hose is used by operating a switch S provided on the hand-held operation pipe P on and off, so as to cause the air sucked from a suction nozzle head N attached to a distal end of the operation pipe P. The cleaner hose guides and send the sucked air to the vacuum cleaner body C via the operation pipe P and a cleaner hose H.

With the above-described conventional cleaner hose, there has been a problem in that the overall weight of the hose is heavy since a power conducting wire is provided separately from the metal wire for reinforcing the hose. As a result, when the vacuum cleaner is a used for a long time, the user becomes fatigued easily. In addition, there has been a problem in that the cleaner hose is unable to withstand extended periods of use and the disconnection of the wire can occur since a slender conducting wire is used.

SUMMARY OF THE INVENTION

It is, therefore, an object of the present invention to overcome the above-mentioned drawbacks found in the conventional cleaner hose. That is, it is an object of the present invention to provide a cleaner hose that is light in weight and free from disconnection. More particularly, it in object of the present invention to develop a cleaner hose in which the overall weight of the hose is made light, which can be used with ease and less fatigue, and which is made free of the risk of disconnection even if used over extended periods.

The above-mentioned object can be attained by a cleaner hose comprising:

a synthetic resin pipe wall;

two steel wires; and two synthetic resin wires harder than the resin pipe wall; in which each of the steel wires and each of the two synthetic resin wires are alternately and spirally wound in an inner side of the synthetic resin pipe wall at predetermined intervals.

The above-mentioned construction of the cleaner hose according to the present invention, advantageously, further comprises:

a first electric connector attached at the one end of a pipe body defined by the resin pipe wall; and a second electric connector attached at the other end of the pipe body, in which the second electric connector is electrically connected to the second connector through the two steel wires.

In the above-mentioned construction of the cleaner hose according to the present invention, advantageously, the steel wires and the resin wires are bonded to the inner surface of the pipe wall.

In addition, in the above-mentioned construction of the cleaner hose according to the present invention, advantageously, the pipe wall comprises an outer layer and an inner layer, and the steel wires and the resin wires are interposed between the inner and outer layers.

Further, in the above-mentioned construction of the cleaner hose according to the present invention, advantageously, each of the steel wires is coated with a synthetic resin.

Furthermore, in the above-mentioned construction of the cleaner hose according to the present invention, advantageously, each of the resin wires is a hollow shape.

DETAILED DESCRIPTION OF THE PREFERRED EMBODIMENTS

With a view to overcoming the problems of such a conventional cleaner hose, it is suggestible to eliminate the conventional electric power conducting wire for electrically conducting the power, to make the length of the metal wire for ensuring a shape retention of the hose as practically short as possible, and to utilize such metal wire as an electrical power conducting wire.

Figure 2:
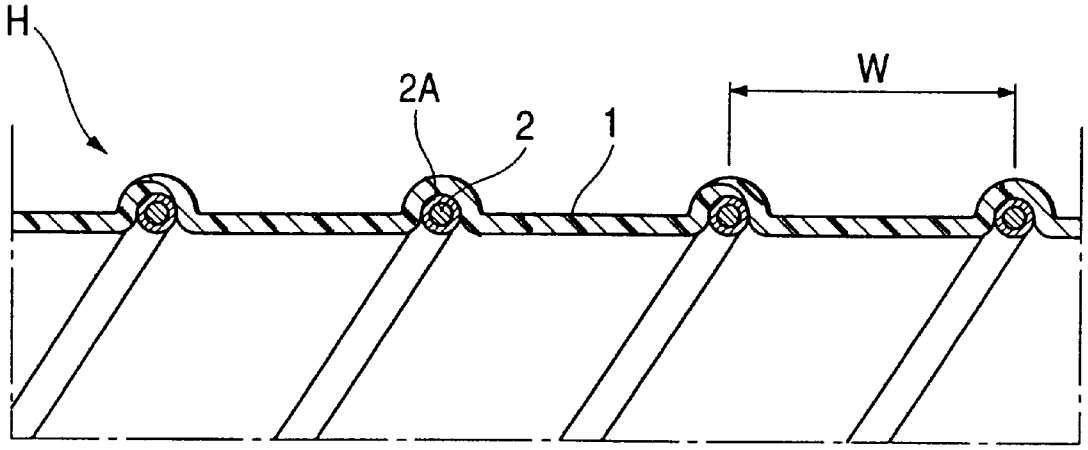
FIG. 2 PRIOR ART
FIG. 2 is an enlarged sectional view of the pipe wall portion of the hose with a structure in a prior art.
Figure 3:
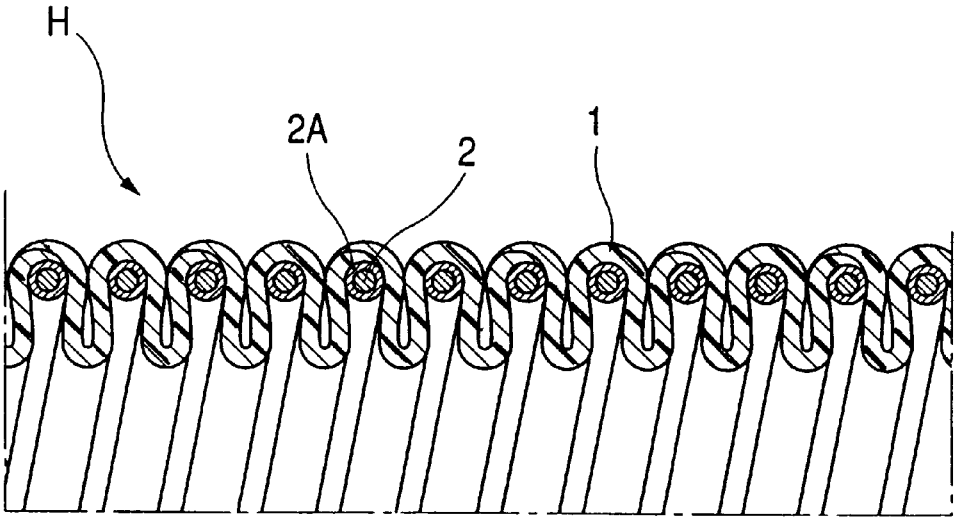
FIG. 3 PRIOR ART
FIG. 3 is a sectional view of the pipe wall portion illustrating a deformed state of the hose shown in FIG. 2.

Upon considering the above-mentioned desires, the present inventors conceived an improved hose H, shown in prior art FIGS. 2 and 3, as a cleaner hose in which the overall weight of the hose is made light, which can be used with ease and less fatigue, and which is made free from the risk of disconnection even if used over extended periods, by eliminating the conventional power conducting wire for conducting power, and by using that metal wire at the power conducting wire.

As shown in FIG. 2, this hose H is arranged such that two resin-coated wires 2A in which hard steel wires 2 are coated with a resin are spirally wound, and their outer peripheries are fused with a pipe wall 1 which is formed by similarly winding a thin belt-shaped material made of a soft synthetic resin, so as to be formed integrally, in this hose H, a wiring interval W between the resin-coated wires 2A is set to about twice that of the above-described conventional hose.

However, if this hose H is used by being attached to the vacuum cleaner as described above, and if suction resistance increases and the negative pressure within the hose increases as the suction port of the suction nozzle at the distal end of the operation pipe abuts against the cleaning surface of an object being cleaned, such as a carpet, owing to the suction force of the vacuum cleaner body, it becomes impossible for the hose to maintain its normal shape by itself. Thus there is a possibility that the pipe wall becomes shrunk and deformed in the axial direction of the pipe and that the hose becomes deformed into a short hose, as shown in FIG. 3. If the hose becomes deformed and short, the effective inside diameter of the pipe becomes small due to the dipped creases of the pipe wall, and the suction resistance increase, resulting in a large loss of suction pressure. At the same time, there is also a possibility that there is the risk of the vacuum cleaner body hitting the user as the hose becomes shrunk and deformed, and even if it does not hit the user, the vacuum cleaner body becomes too close to the user and the ease of use therefore deteriorates.

Hereinafter, preferred embodiments according to the present invention are described with reference to FIGS. 4–11.

Figure 4:
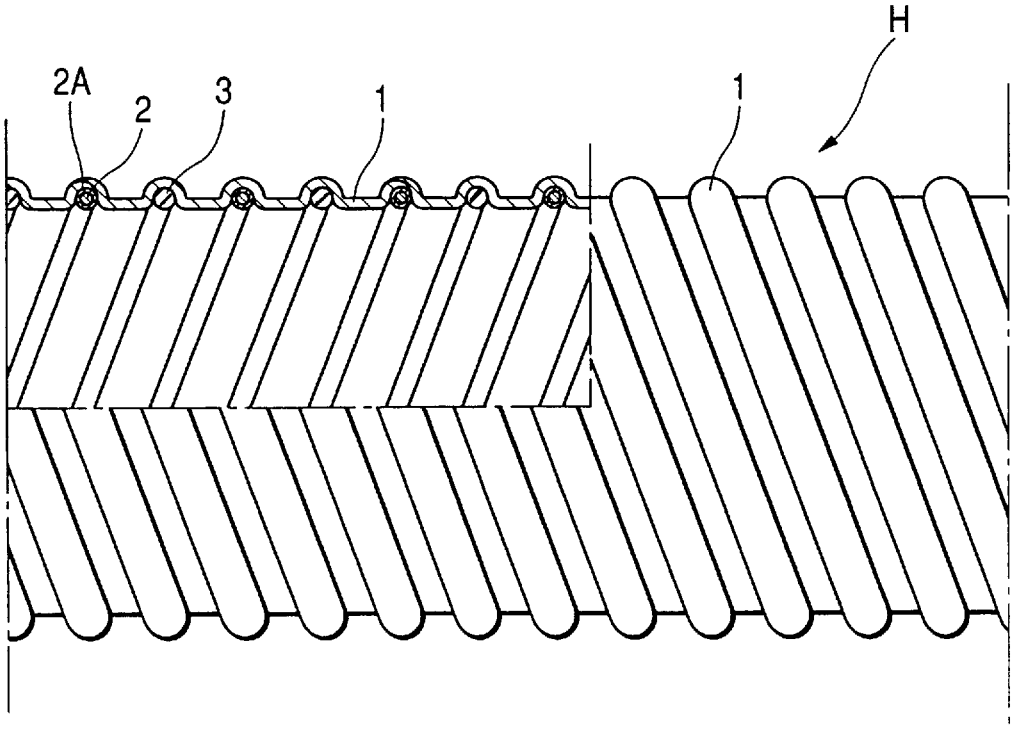
FIG. 4 is a partially cut-out front view illustrating a first embodiment.
Figure 5:
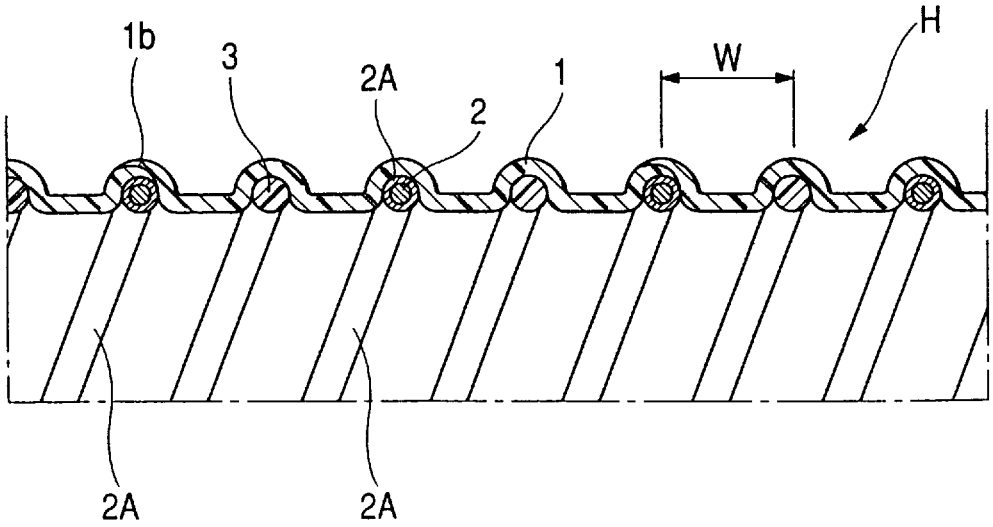
FIG. 5 is an enlarged sectional view of a pipe wall portion in the first embodiment; shown in FIG. 4
Figure 6:
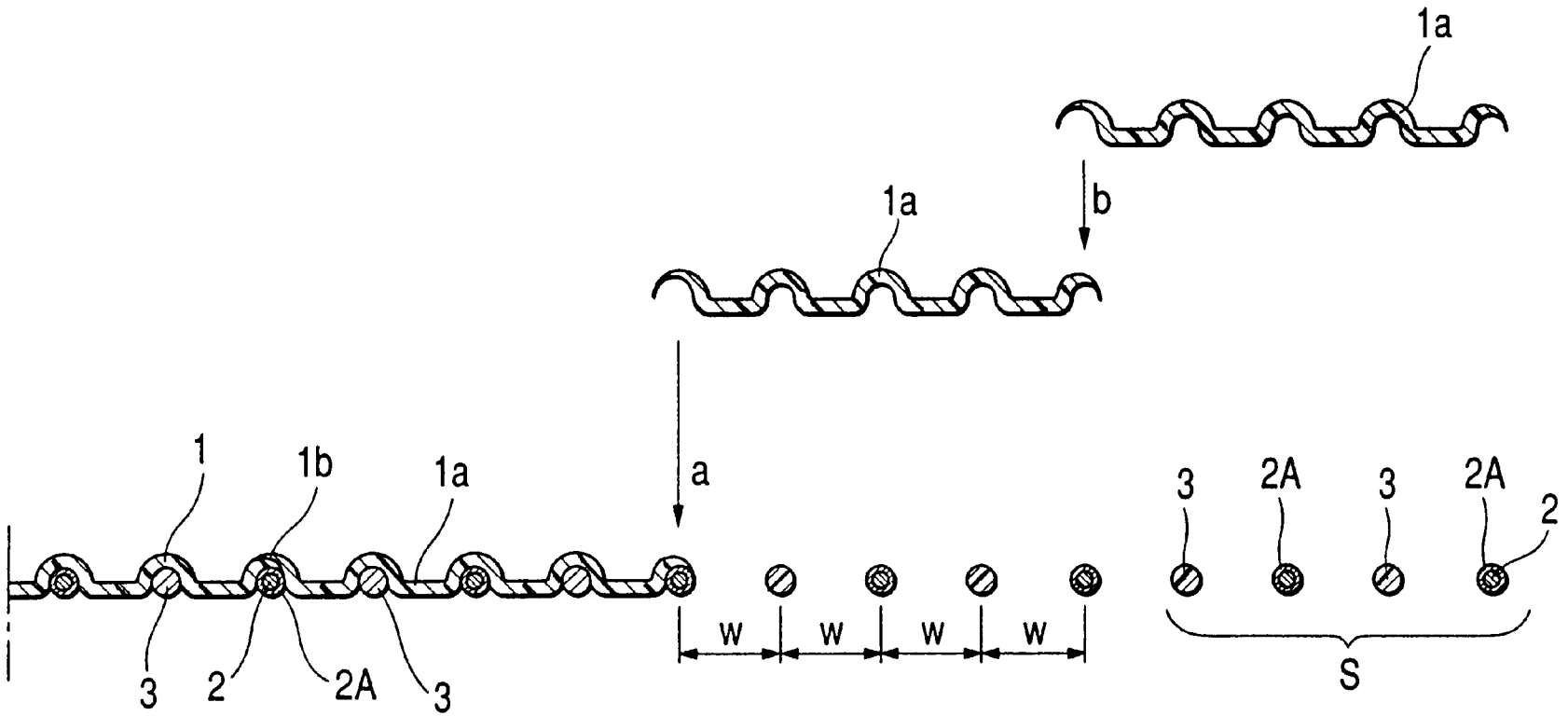
FIG. 6 is an explanatory exploded sectional view of the pipe wall.
Figure 7:
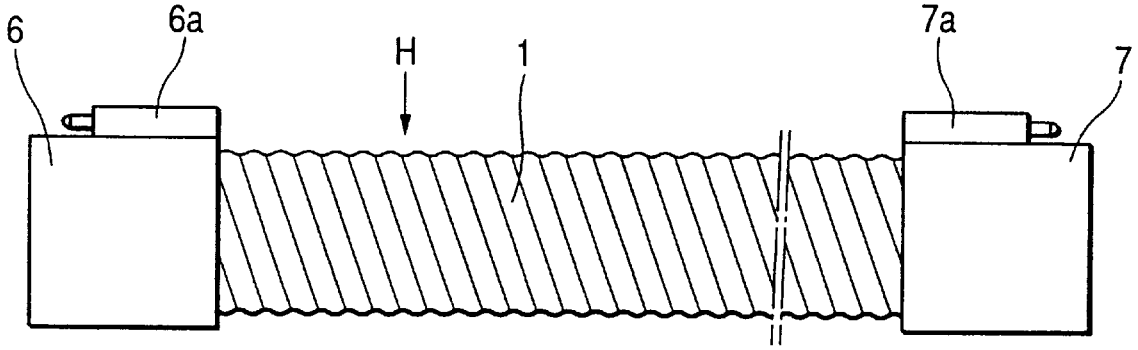
FIG.7 is a front view illustrating the state in which connection pipes are coupled, an intermediate portion of the hose being omitted.

FIGS. 4 to 7 are diagram illustrating a first embodiment of the present invention, in which FIG. 4 is a fragmentary diagram illustrating an external shape of the hose H, FIG. 5 is an enlarged view illustrating the cross-sectional shape of a pipe wall portion, FIG. 6 is an exploded view illustrating means for forming the hose H, and FIG. 7 is a view illustrating the state in which connecting pipes are respectively connected to both ends of the hose H. In the hose H, a pipe wall 1 having a spirally corrugated shape is formed by using a material such as soft polyvinyl chloride (PVC), polyethylene (PE), polypropylene (PP), an ethylene vinyl acetate (EVA) elastomer, or any other soft synthetic resin material, or a material in which rubber is mixed with such a material. The pipe wall 1 in this embodiment is formed by a single layer.

As shown in FIG. 6, on the inner side of the protrusion of the corrugation, two coated wires 2A and two resin wires 3 are alternately arranged and wound spirally at predetermined intervals w while keeping the predetermined interval w between the leading winding and the following winding, In the coated wires 2A, steel wires, piano wires, or other hard wires obtained by subjecting such wires to corrosion-preventive plating (these wires will be collectively referred to as the hard steel wires hereinafter) are used as cores. The outer peripheral surfaces of the hard steel wires are coated with a synthetic resin such as semi-hard PVC, or a material obtained by mixing, for example, electrically conductive calcium carbonate with a synthetic resin. Meanwhile, the resin wires are similarly formed of a synthetic resin such as semi-hard PVC and each of the resin wires is provided with the same diameter as that of the coated wire 2A. These coated wires 2A and the resin wires 3 are fused to the pipe wall 1. However, coated wires 2A and the resin wires 3 may be bonded to the pipe wall 1 by applying an adhesive g to the wires, an shown in FIG. 9.

FIG. 6 also shows the arrangement of wires in this embodiment. The hose H of this embodiment is formed by combining four wires with a tape as described hereinafter. Two wires of the four is coated wires 2A obtained by coating the reinforcing wires 2 with the resin and others are resin wires 3. The coated wires 2A and resin wires 3 are alternately arranged at the predetermined intervals w, and are wound spirally while keeping the predetermined interval w between the leading winding and the following winding. Such two coated wires 2A and two resin wires are used as a set 5. If necessary the coated wires 2A and resin wires 3 are wound spirally while applying the adhesive to the upper surfaces of the wires.

A soft resin tape 1*a* formed with a width slightly larger than the interval (4*w*) for five of these wires is wound spirally an the upper surfaces thereof such that its opposite edges are each located on the upper surface of every fifth wire. Then, the soft resin tape 1*a* is fused or bonded to the wires while one side edge of the tape 1*a* is being superposed on an adjacent side edge of the leading wound tape 1*a* as indicated by arrows a and b in FIG. 6. The superposed surfaces are fused or bonded together by the adhesive thereby consecutively forming the hose H.

As shown in FIG. 7, the hose H formed is cut to a length necessary for the vacuum cleaner, connecting pipes 6 and 7 formed separately are respectively attached to its opposite ends. The two reinforcing wires 2 on the pipe wall 1 are electrically connected to respective connectors 6*a* and 7*a*, thereby forming an electric circuit between the two connectors 6*a* and 7*a*.

Figure 1:
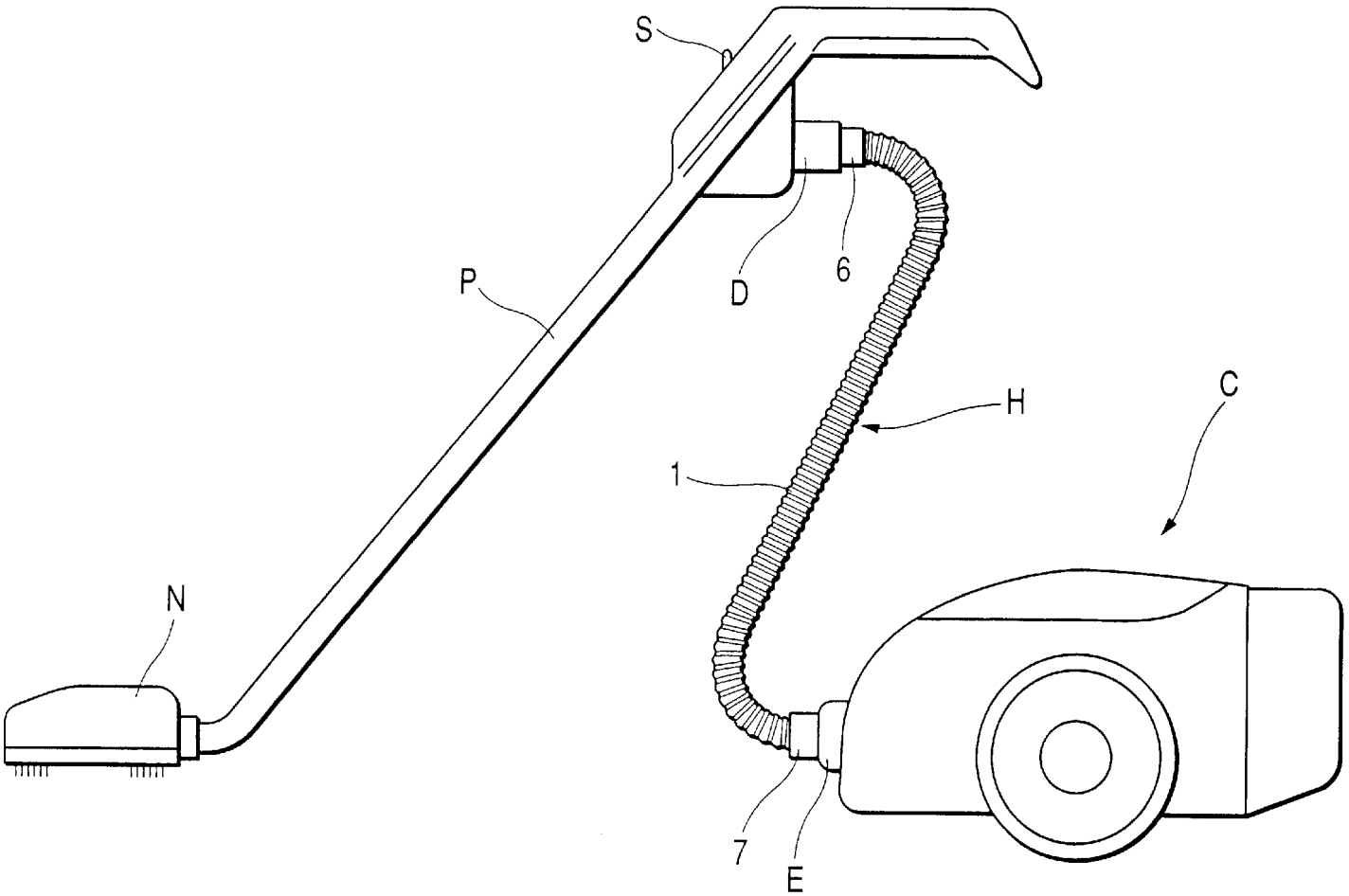
FIG. 1 is a side view illustrating the state in which the hose is connected to an electric vacuum cleaner.

As shown in FIG. 1, in order to use the cleaner hose H with the connecting pipes 6 and 7 connected to the opposite ends in the above-described manner, the connecting pipe 7 at one end thereof is inserted into and connected to the suction pipe E of an electric vacuum cleaner C, and the connecting pipe 6 at the other end thereof is inserted in and connected to a suction pipe D at an upper end of an operation pipe P. These connection of the connecting pipes 6 and 7 allows a suction path and an electric circuit for operating the cleaner body to be formed between the cleaner body C and the operation pipe P.

As examples of dimensions of the above-described cleaner hose H, the inside diameter of the hose is 45 mm, the average wall thickness of the pipe wall 1=0. 5 mm, the diameter of the reinforcing wire is 0.9 mm, the diameter of the coated wire 2A is 1.5 mm, the diameter of the resin wire 3 is 1.5 mm and the interval w between adjacent wires is 10 mm.

Figure 8:
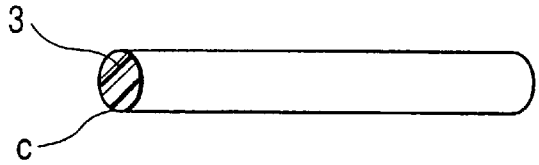
FIG. 8 is a perspective view illustrating another example of a resin wire.
Figure 9:
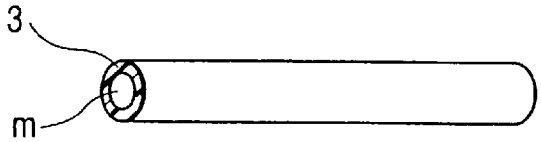
FIG. 9 is a sectional view illustrating a portion of the hose in accordance with another embodiment, and corresponds to FIG. 5.

FIGS. 8 and 9 respectively show modifications of the resin wire 3 in accordance with the present invention.

In the modification shown in FIG. 8, the pipe wall 1 is made of a PVC resin and the resin wire 3 is made of a PP resin, so that an adhesiveness between the two resins is not satisfactory. Therefore a coating layer c is provided by coating the PP wire with a PVC resin so as to improve the adhesiveness with respect to the pipe wall 1.

Moreover, the resin wire 3 shown in FIG. 9 is formed as a hollow wire having a hollow portion m at its central portion is so as to make the resin wire 3 lighter.

Figure 10:
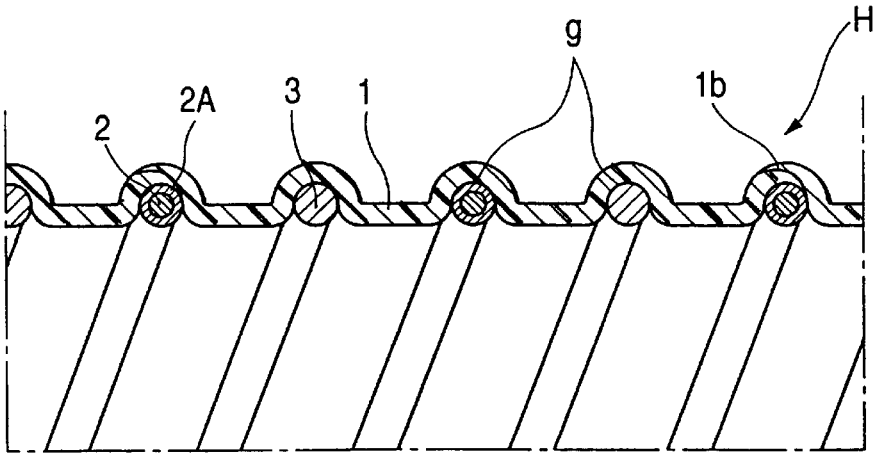
FIG. 10 is a perspective view illustrating still another example of the resin wire.

Another embodiment is shown in FIG. 10. As for the hose H shown in FIG. 10, a structure is shown in which its basic structure is the same as the cleaner hose shown in the above-described first embodiment, but the pipe wall 1 and the wires 2A and 3 are bonded together only at the upper portions of the wires as the portions bonded by the use of the adhesive g. Although a structure may be adopted such that the wires are bonded to the pipe wall at the overall contact surfaces, the wires are able to be bonded at parts of the contact surfaces as in the illustrated case. This arrangement is more preferable, because the flexibility of the pipe wall 1 is not hampered.

Figure 11:
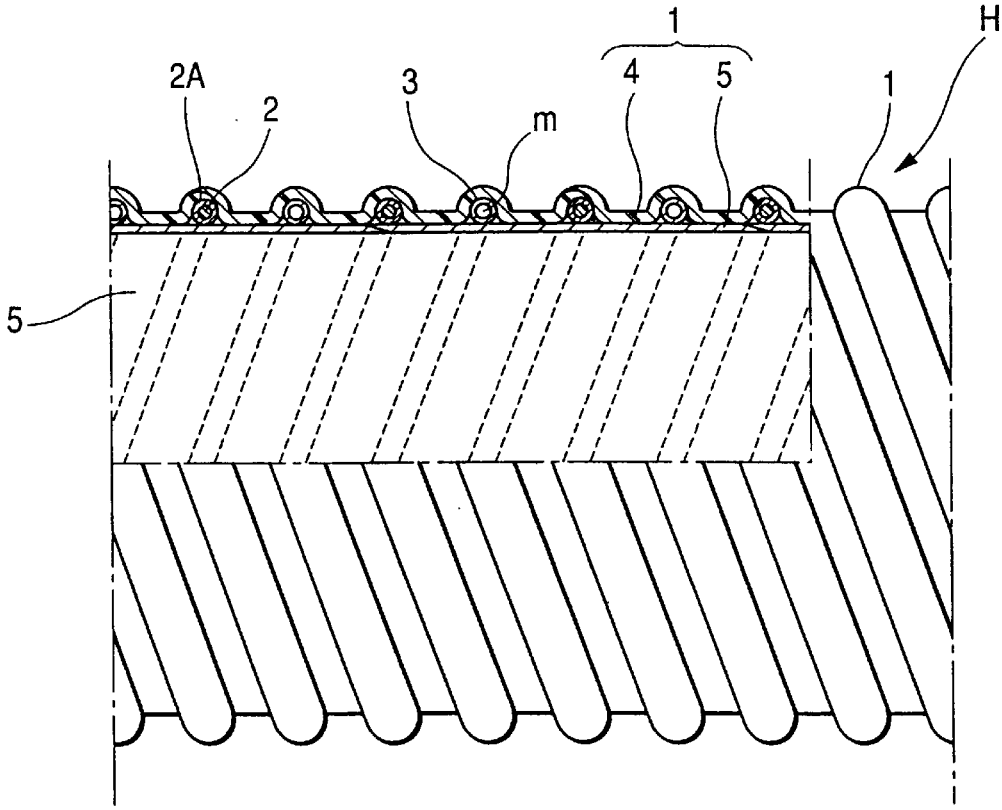
FIG. 11 is a partially cut-out front view illustrating a portion of the hose in accordance with still another embodiment, and corresponds to FIG. 7.

FIG. 11 shows still another embodiment of the hose. In this structure, the pipe wall 1 of the hose H is formed as a two-layered structure including the outer layer 4 and the inner layer 5. The two hard steel wire-made reinforcing wires 2 (coated wires 2A) provided with insulating coating and the resin wires 3 are alternately arranged in the sane way as the above-described first embodiment. Then, the two reinforcing wires 2 and the two resin wires 3 are interposed between the inner and outer two layers 4 and 5. In this case, if the reinforcing wires 2 is used in the state of bare wires, which are not provided with insulating coating, the overall weight of the hose can be made further lighter. Although not shown in the drawings, reinforcing fibers may be interposed between the two outer and inner layers 4 and 5.

As has been described hereinabove, the cleaner hose in accordance with the present invention is arranged such that the resin wires and the reinforcing wires for retaining the shape the pipe wall are used while the power conducting wires are eliminated. The resin wires and the reinforcing wires can be wound into a spiral, and the spiral can have larger angle of inclination compared with wires in a conventional cleaner hose. As a result, the absolute length of the reinforcing wires themselves can be made as practically short as possible, and the overall weight of the hose can be substantially light. Moreover, the resin wires can be arranged between the reinforcing wires to prevent the shrinking deformation of the pipe wall of the hose. Therefore it is possible to expect noticeable advantages, First, even if large negative pressure occurs within the hose due to the powerful suction force of the vacuum cleaner body, the cleaner hose is not easily liable to undergo shrinking deformation. Second, the cleaner hose can be always used safely in a easy-to-use state. Third, the cleaner hose can be used without imparting a sense of fatigue to the user owing to the light weight of the overall hose.

In addition, it is possible to attain simplified and speedy operation in the Manufacture since it suffices if four wires including the two resin wires and the two reinforcing wires or coated wires are used as a set, and these four wires are arranged and wound spirally. Thus it is possible to lower the manufacturing cost.

The present application is based on Japanese Patent Application No. Hei. 9-197912.

Although a description has been given of the embodiments which are considered as representative of the present invention, the present Invention is not necessarily limited to the structures of these embodiments, and may be implemented by being modified as required within the scope in which the above-described constituent requirements of the present invention are provided, the object of the present invention can be attained, and the advantages which are described below can be exhibited.

What is claimed is:

1. A cleaner hose comprising:

a synthetic resin pipe wall;

two steel wires; and two synthetic resin wires harder than said resin pipe wall, wherein each of said steel wires and each of said two synthetic resin wires are alternately and spirally wound in an inner side of the synthetic resin pipe wall at predetermined intervals.

2. The cleaner hose according to claim 1, further comprising:

a first electric connector attached at the one end of a pipe body defined by said resin pipe wall; and a second electric connector attached at the other end of said pipe body, in which said second electric connector is electrically connected to said second connector through said two steel wires.

3. The cleaner hose according to claim 1, wherein said steel wires and said resin wires are bonded to the inner surface of said pipe wall.

4. The cleaner hose according to claim 2, wherein said steel wires and said resin wires are bonded to the inner surface of said pipe wall.

5. The cleaner hose according to claim 1, wherein said pipe wall comprises an outer layer and an inner layer, and said steel wires and said resin wires are interposed between said inner and outer layers.

6. The cleaner hose according to claim 1, wherein each of said steel wires is coated with a synthetic resin.

7. The cleaner hose according to claim 2, wherein each of said steel wires is coated with a synthetic resin.

8. The cleaner hose according to claim 3, wherein each of said steel wires is coated with a synthetic resin.

9. The cleaner hose according to claim 4, wherein each of said steel wires is coated with a synthetic resin.

10. The cleaner hose according to claim 5, wherein each of said steel wires is coated with a synthetic resin.

11. The cleaner hose according to claim 1, wherein each of said resin wires is a hollow shape.

12. The cleaner hose according to claim 2, wherein each of said resin wires is a hollow shape.

13. The cleaner hose according to claim 3, wherein each of said resin wires is a hollow shape.

14. The cleaner hose according to claim 4, wherein each of said resin wires is a hollow shape.

15. The cleaner hose according to claim 5, wherein each of said resin wires is a hollow shape.

16. The cleaner hose as recited in claim 1, wherein two synthetic resin wires comprised of a semi-hard PVC.

17. The cleaner hose as recited in claim 6, wherein the synthetic resin is a semi-hard PVC.

18. The cleaner hose as recited in claim 7, wherein the synthetic resin is a semi-hard PVC.

19. The cleaner hose as recited in claim 8, wherein the synthetic resin is a semi-hard PVC.

20. The cleaner hose as recited in claim 9, wherein the synthetic resin is a semi-hard PVC.

21. The cleaner hose as recited in claim 10, wherein the synthetic resin is a semi-hard PVC.

* * * * *